US008272078B2

(12) United States Patent
Snow et al.

(10) Patent No.: US 8,272,078 B2
(45) Date of Patent: Sep. 25, 2012

(54) APPARATUS AND SYSTEM FOR A SUCTION ENTRAPMENT AND ENTANGLEMENT AVOIDANCE RETROFIT/NEW INSTALLATION

(75) Inventors: Bonnie Snow, Provo, UT (US); Teri S. Snow, Provo, UT (US); Ronald A. Tobler, Payson, UT (US)

(73) Assignees: Bonnie Snow, Provo, UT (US); Teri Snow, Provo, UT (US)

( * ) Notice: Subject to any disclaimer, the term of this patent is extended or adjusted under 35 U.S.C. 154(b) by 1044 days.

(21) Appl. No.: 12/174,469

(22) Filed: Jul. 16, 2008

(65) Prior Publication Data

US 2009/0019633 A1 Jan. 22, 2009

Related U.S. Application Data

(60) Provisional application No. 60/950,998, filed on Jul. 20, 2007.

(51) Int. Cl.
*E04H 4/00* (2006.01)

(52) U.S. Cl. ..... 4/504; 4/507

(58) Field of Classification Search ..... 4/504, 507, 4/286–288, 292, DIG. 14
See application file for complete search history.

(56) References Cited

U.S. PATENT DOCUMENTS

| | | | |
|---|---|---|---|
| 3,378,858 | A | 4/1968 | Jacuzzi |
| 3,940,807 | A | 3/1976 | Baker et al. |
| 4,170,047 | A | 10/1979 | Corsette et al. |
| 5,372,715 | A | 12/1994 | Maggard et al. |
| 5,734,999 | A | 4/1998 | Nicholas |
| 5,978,981 | A | 11/1999 | Nelson |
| 6,170,095 | B1 | 1/2001 | Zars |
| 6,230,337 | B1 | 5/2001 | Barnett |
| 6,393,631 | B2 | 5/2002 | Schroader |
| 6,397,408 | B1 | 6/2002 | Veloskey et al. |
| 6,453,482 | B1 | 9/2002 | Mullings |
| 6,588,029 | B2 | 7/2003 | Mullings |
| 6,615,417 | B1 | 9/2003 | Newhard |
| 6,738,994 | B2 | 5/2004 | Barnett et al. |
| 6,810,537 | B1 | 11/2004 | Barnes et al. |
| 6,817,043 | B2 | 11/2004 | Zars |
| 7,179,179 | B2 | 2/2007 | Barnes |

OTHER PUBLICATIONS

PCT International Search Report and Written Opinion, PCT/US08/70356, Oct. 22, 2008.

"American National Standard for Suction Entrapment Avoidance in Swimming Pools, Wading Pools, Spas Hot Tubs, and Catch Basins", ANSI/APSP-7 2006.

*Primary Examiner* — Korie Chan
(74) *Attorney, Agent, or Firm* — Kunzler Law Group, PC

(57) ABSTRACT

An apparatus and system are disclosed for a pool drain cover, the cover having a perforated ramp around its perimeter to which are attached a plurality of straight, horizontally disposed tubes, circumscribing channels with substantially continuous cross-sectional areas, each tube enclosing a channel extending the length of the tube of at least six inches. The cross-sectional area of the tubes is kept at a minimum and their number is increased by arranging the tubes in rows and columns or giving the tubes an elliptical cross-sectional area and arranging them in a single row, thereby reducing the tapering in the tubes. The cover may be segmented and may be of multiple shapes, including a circle.

29 Claims, 15 Drawing Sheets

APPARATUS AND SYSTEM FOR A SUCTION ENTRAPMENT AND ENTANGLEMENT AVOIDANCE RETROFIT/NEW INSTALLATION

CROSS-REFERENCES TO RELATED APPLICATIONS

This application is a continuation-in-part of and claims priority to U.S. Provisional Patent Application No. 60/950,998 entitled APPARATUS, SYSTEM, AND METHODE FOR A SUCTION ENTRAPMENT AVOIDANCE RETROFIT/NEW INSTALLATION FOR SWIMMING POOL OUTLETS and filed on Jul. 20, 2007 for Bonnie Snow, Teri Snow, and Ronald A. Tobler, which is incorporated herein by reference.

BACKGROUND OF THE INVENTION

1. Field of the Invention

This invention relates to pool safety equipment and more particularly relates to pool drain covers.

2. Description of the Related Art

The filtration of swimming pools, wading pools, and spas requires the use of powerful pumps that remove water through a drain or drains. These pumps create such a strong suction force that the Federal Government estimates that between 1997 and 2003, 150 deaths and serious injuries, including disembowelment, are attributable to pool drains. To prevent future deaths and injuries, several devices have been developed that cover pool drains in ways that mitigate the potential for suction entrapment, entanglement, or disembowelment.

Various grate and perforated plate designs have been employed to prevent swimmers from coming into direct contact with a pool drain. However, the possibility still remains that the back or chest of an individual may cover the entire grate or plate, resulting in suction entrapment. Additionally, an individual's hair, jewelry, limbs, or swimsuit may become entangled on the other side of such a perforated plate or grate. To address the issue of entanglement certain gates are provided with, as depicted in FIG. 1, vertically disposed channels 102 extending from the openings of the grate. These channels prevent entanglement by preventing the twisting of hair, jewelry, or clothing that has passed through the grate from different openings. However, the problem of suction entrapment remains unaddressed. Additionally, grates with such vertically disposed channels require a large cavity 104 in a pool floor above the pool drain to house the channel's extending from the grate.

Unfortunately, although extending vertically disposed channels 102 may help avoid entanglement, the vertically disposed channels 102 do not mitigate the problem of suction entrapment of a large body area, such as a back or a chest covering the grate. Additionally, the requirement for such a large cavity in a pool floor makes it difficult to retrofit pools without such large cavities 104 with a grate comprising vertically disposed channels.

Certain designs, therefore, incorporate horizontally disposed channels to mitigate entanglement. These horizontally disposed channels extend outward radially from a central location near the pool drain to distal openings situated within a drain cover that sits on the pool floor. Since the cover rests on the pool floor, no cavity around the pool drain is required and the covers can more easily be added to existing pools. Additionally, the length of the channels places the distal openings along the perimeter of the cover in a number of locations that cannot all be easily covered by a single human body, thereby creating an obstacle to suction entrapment.

However, the horizontally disposed channels exhibit certain design flaws that fail to harness the full potential of horizontally disposed tubes to avoid entanglement and suction entrapment. For example, certain designs disclose channels defined by the gaps between a few ribs that support a flat disk shaped cover resting on a pool floor. By defining the channels as the space between these ribs, a minimal number of channels result and the resulting channels have a wide opening on the distal end and a narrow outlet near the pool drain.

Although it may be difficult for the body of a single individual to block a few openings on a radially disposed disk, the clothes of the individual, such as a large T-shirt, and/or additional individuals may block the few openings provided, even when those openings are disposed on the perimeter of a disk shape. Furthermore, channels with a wide opening can take in large amounts of hair, clothing, equipment, and jewelry. The tapering can create turbulence and cross currents that can entangle the material that may lodge in a narrowed region of the channel or on the other side of the channel's outlet. Additionally, the larger amount of material that enters a channel, the larger amount of material that may make it to the outlet of the channel to entangle with material from other channels.

An additional design discloses curved channels that twist their way from the opening at the distal ends to outlets at the pool drain. Twisting channels result in internal turbulence that may promote entangled masses within a channel that may lodge in a turning passageway or beyond the outlet of the channel. Additionally, the curved path of hair, clothing, jewelry and other items sucked into such channels results in increased friction and opportunities for catching when efforts are made to extract these items. For example, a piece of jewelry, such as a cross that entered a tube along its length, may become entrapped by a cam action within the curved channel when pulled at an angle different from the angle at which the device entered the channel.

SUMMARY OF THE INVENTION

From the foregoing discussion, it should be apparent that a need exists for an apparatus and system that prevent suction entrapment and entanglement with pool drains and pool drain covers. Beneficially, such an apparatus, system, and method would work to further reduce the possibility of suction entrapment and entanglement through the improved design of horizontal channels extending from openings in a pool drain cover.

The present invention has been developed in response to the present state of the art, and in particular, in response to the problems and needs in the art that have not yet been fully solved by currently available pool drain covers. Accordingly, the present invention has been developed to provide an apparatus and system for pool drain covers that overcome many or all of the above-discussed shortcomings in the art.

The apparatus is a pool drain cover comprised of a cover for housing a plurality of straight, horizontally disposed tubes circumscribing channels with substantially continuous cross-sectional areas, each tube having a distal opening connected with the cover and a proximal opening directed substantially at the center of the cover. The length of the tubes may range between six and twenty-four inches. The tubes each may comprise a channel extending the length of the tube with a substantially elliptical cross sectional area, the elliptical cross sectional area having a major axis of a length greater than that of the minor axis.

The apparatus may also comprise a ramp described by the cover and ascending from the perimeter of the cover. In certain embodiments, the ramp rises less than three inches at a grade less than thirty (30) degrees to a non-perforated region of the cover that may be either flat or domed shaped.

In certain embodiments, and the major axis of the substantially elliptical cross sectional area of each channel is disposed from the bottom of the ramp to its top so that the channel occupies most of the distance from a point at the top of the ramp to a point at the bottom of the ramp. A series of tubes with channels whose distal openings are arranged one next to the other may be placed in a single row around the ramp. In certain embodiments, tubes are arranged in multiple rows within the ramp.

A system of the present invention is also presented. In particular, the system, in one embodiment, includes a segmented cover for covering a drain, the segmented cover having a center and extending outward from the central point in all three-hundred and sixty degrees of a horizontal plane defined by a direction x and a direction y, where x and y are perpendicular to each other, to occupy a geometric footprint. The distance between at least two points on the perimeter of the first geometric footprint is at least two feet in length.

The system also includes a perforated ramp described by the cover and ascending to a uniform height from a uniform point with relation to a direction z, where z is orthogonal to the horizontal plane defined by x and y, the ramp ascending at a substantially uniform rate of less than thirty (30) degrees from all three-hundred and sixty degrees of the perimeter of the cover to a height less than three inches. The system further includes a flat, non-perforated region of the cover centered at the center of the cover and on top of the ramp.

The system includes a plurality of straight, horizontally disposed tubes circumscribing channels with substantially continuous cross-sectional areas, each channel extending the length of the tube, the channel having a distal opening connected with the cover at a perforated point along the ramp and a proximal opening directed substantially at the center of the cover. Each of the tubes has a length of at least six inches. Each channel has a substantially elliptical cross sectional area, the major axis of the substantially elliptical cross sectional area disposed in the direction z and of a length causing the channel to occupy most of the distance in direction z from a point on top of the ramp to its bottom. Additionally, the system includes a conical cavity with a truncated top under the non-perforated region of the cover and above the pool drain, the proximal opening of each channel emptying into the conical cavity.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are provided. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Referring now to FIG. 2, which depicts a cover 200 for housing a pool drain cover in accordance with the present invention. The cover 200 housing the pool drain cover may be: rectangular, FIG. 2*a*; hexagonal, FIG. 2*b*; circular, FIG. 2*c*; square, FIG. 2*d*; or dome shaped, FIG. 2*e*; among other shapes. In certain embodiments, a single segment of housing 2*f* may be combined with another segment 2*f* to form a double segmented cover 2*g* or with multiple segments 2*f* to form a multiple segmented cover 2*h*. The cover 200 may be formed from a thermoplastic by injection molding, from a thermoplastic by thermoforming, or from thermosetting resin or a thermoplastic by compression molding.

The cover 200 may also be formed from known laminate materials by laminating. The cover 200 may be formed from sheet metal by cutting, bending, and welding. The cover 200 may also be formed from metal by casting. Furthermore, the cover 200 may be made of a shaped ceramic or of blown glass. Other materials and methods are also possible. The cover 200 may be any color and, may for aesthetic reasons, may be clear. Depending on the manufacturing process and other considerations discussed in this disclosure, one of ordinary skill in the relevant art may form the cover 200 in one piece, or from any number of sections.

Figure 1:
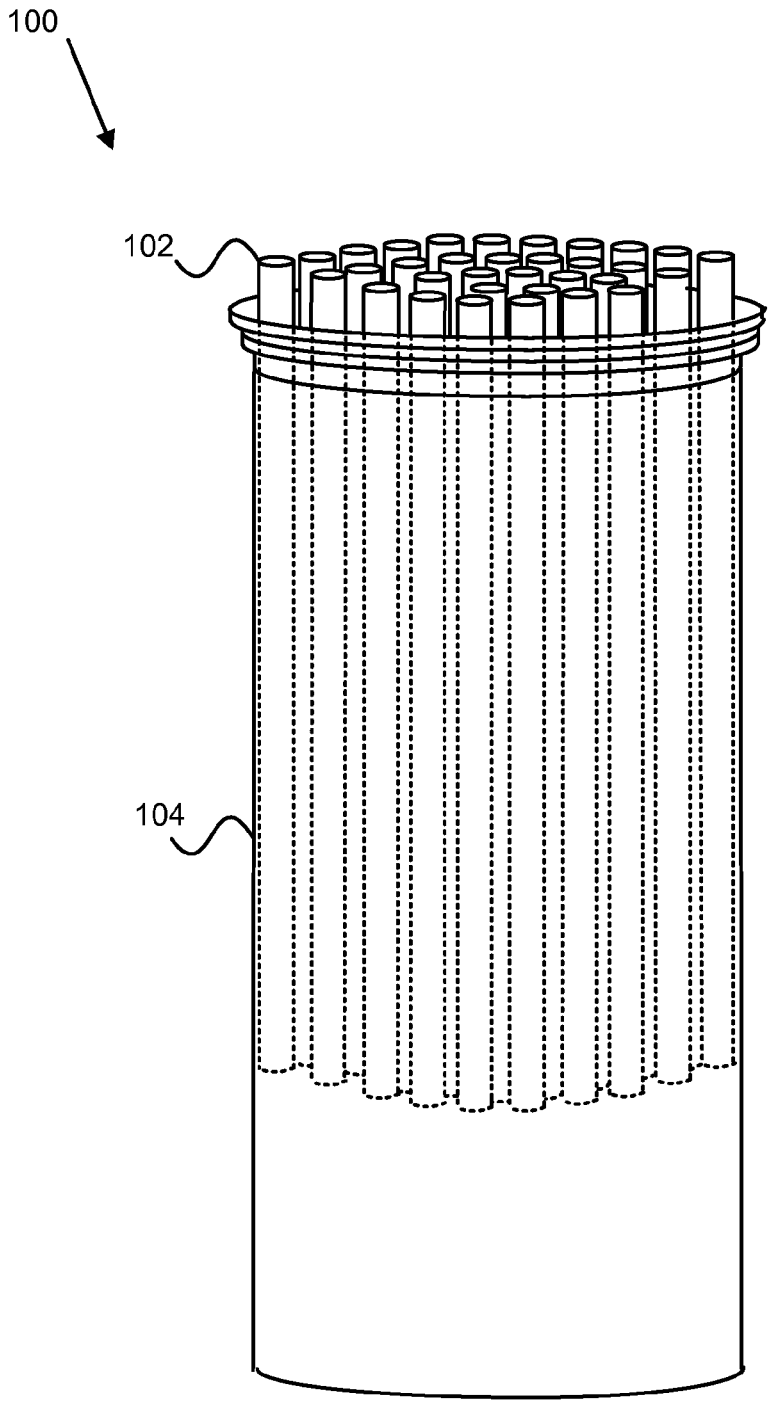
FIG. 1 (Prior Art)
FIG. 1 depicts the vertical disposition of channels in the prior art.
Figure 2A:
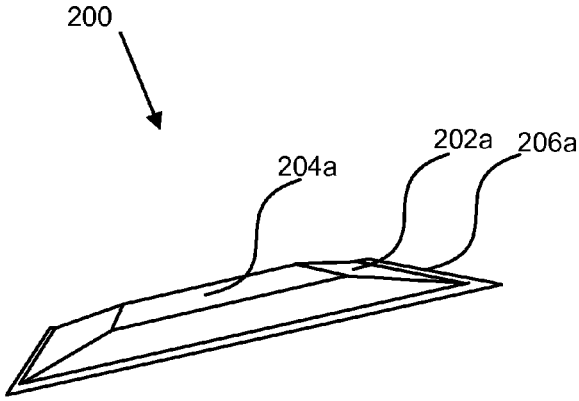
FIGS. 2*a* through 2*h* are perspective views of several embodiments of the cover of the present invention.
Figure 2B:
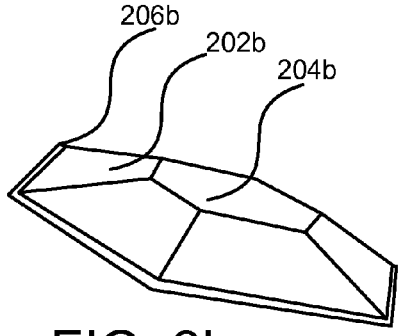
Figure 2C:
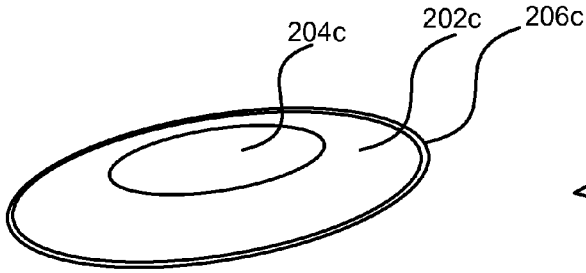
Figure 2D:
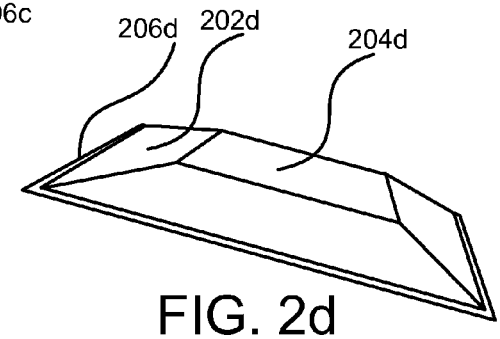
Figure 2E:
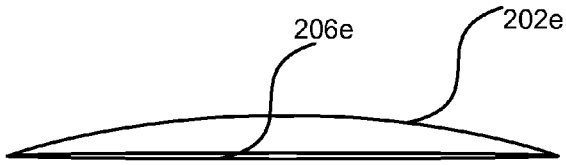

As depicted in FIGS. 2*a* through 2*e*, the cover 200 is provided with a ramp 202*a*-202*e* around the perimeter of the cover 200. In certain embodiments, as shown in FIGS. 2*a*-2*d*, the ramp 202*a*-202*e* ascends at a uniform rate-from all three-hundred and sixty degrees of the perimeter of the cover 200—to a uniform height, from a uniform point, with relation to a common axis. In other embodiments, as shown in FIG. 2*e*, the ramp 202*a*-202*e* ascends from the uniform point, with relation to the common axis, but continues to ascend from all three-hundred and sixty degrees of the cover's 200 perimeter until the center of the perimeter is obtained.

As the ramp 202*a*-202*e* approaches the center of the cover 200, the grade of the ramp 202*a*-202*e* decreases, forming domes of various shapes. In embodiments where the ramp 202*a*-202*e* stops its ascent at a uniform height, a flat region 204*a*-204*d*, extending from the center of the cover 200 to the perimeter of the top of the ramp 202*a*-202*e*, completely fills in the top of the cover 200. The flat region 204*a*-204*d* may be non-perforated. In certain embodiments, the flat region 204*a*-204*d* may be clear or transparent so that the pool drain 302 beneath the cover 200 may be observed.

Figure 12:
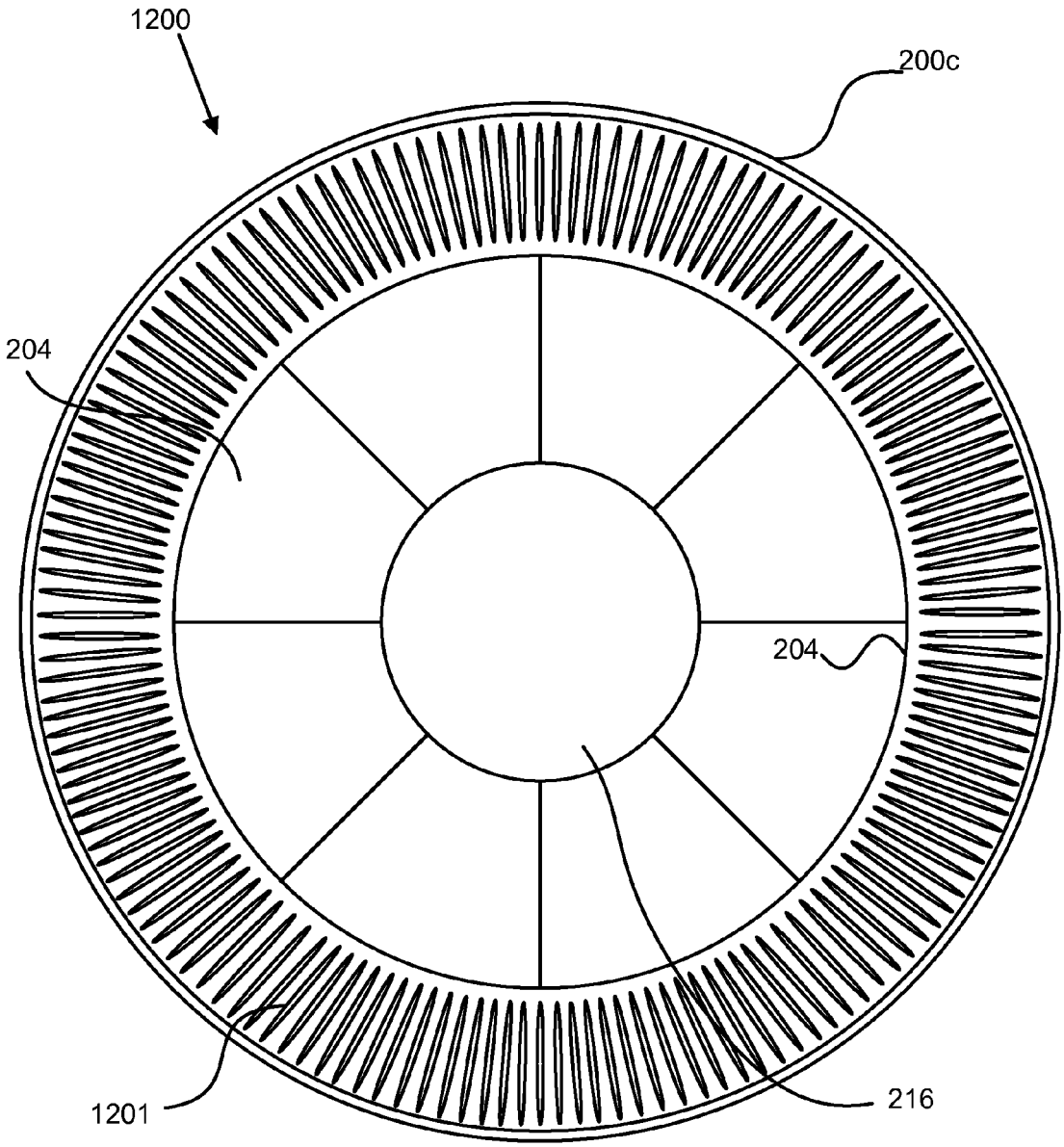
FIG. 12 is a top view of a circular cover with elliptical apertures in a ramp around the perimeter of the cover.
Figure 13:
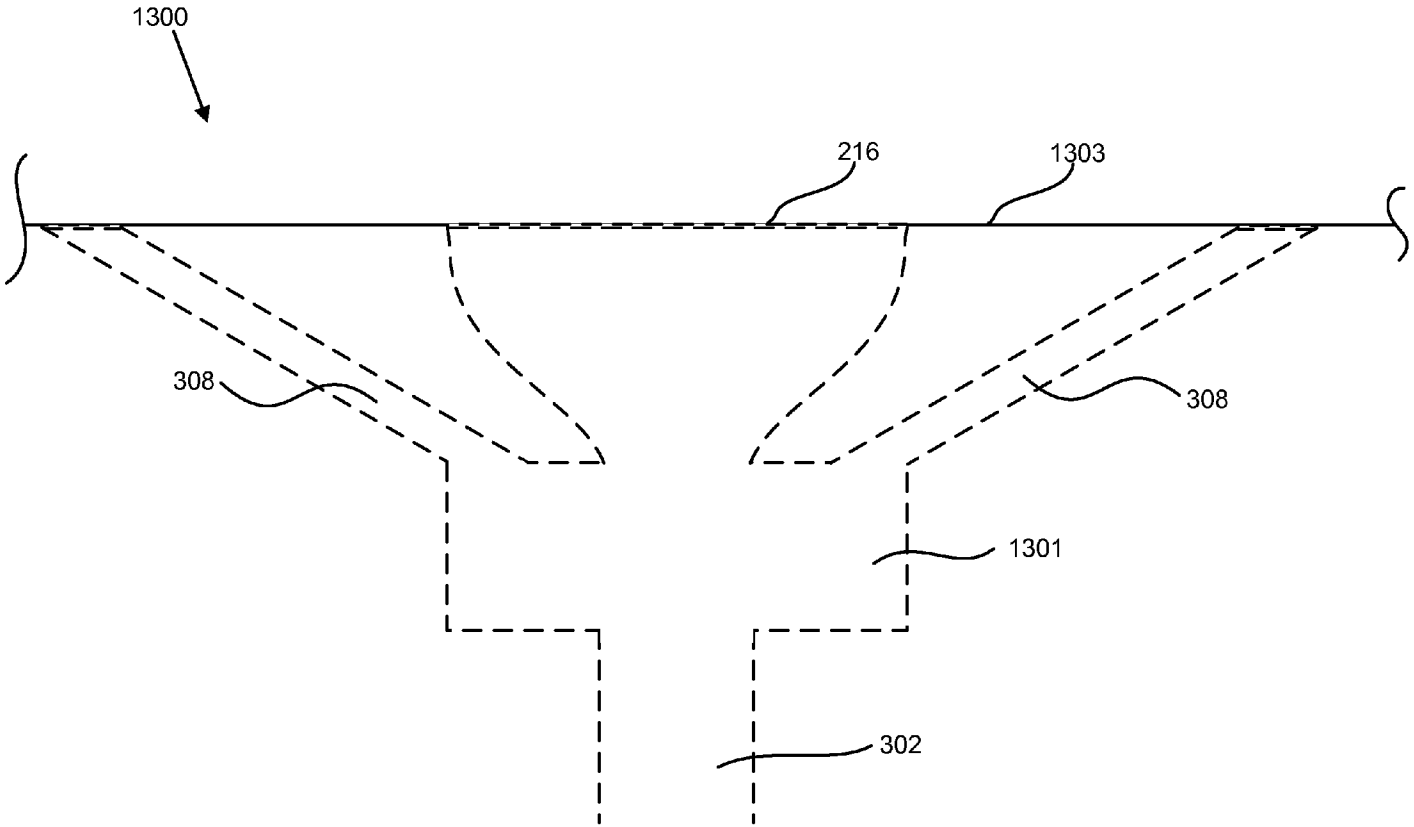
FIG. 13 is a cutaway side view of elliptical channels extending down from the top of the cover, the top of the cover being the same plane as a pool floor.
Figure 14:
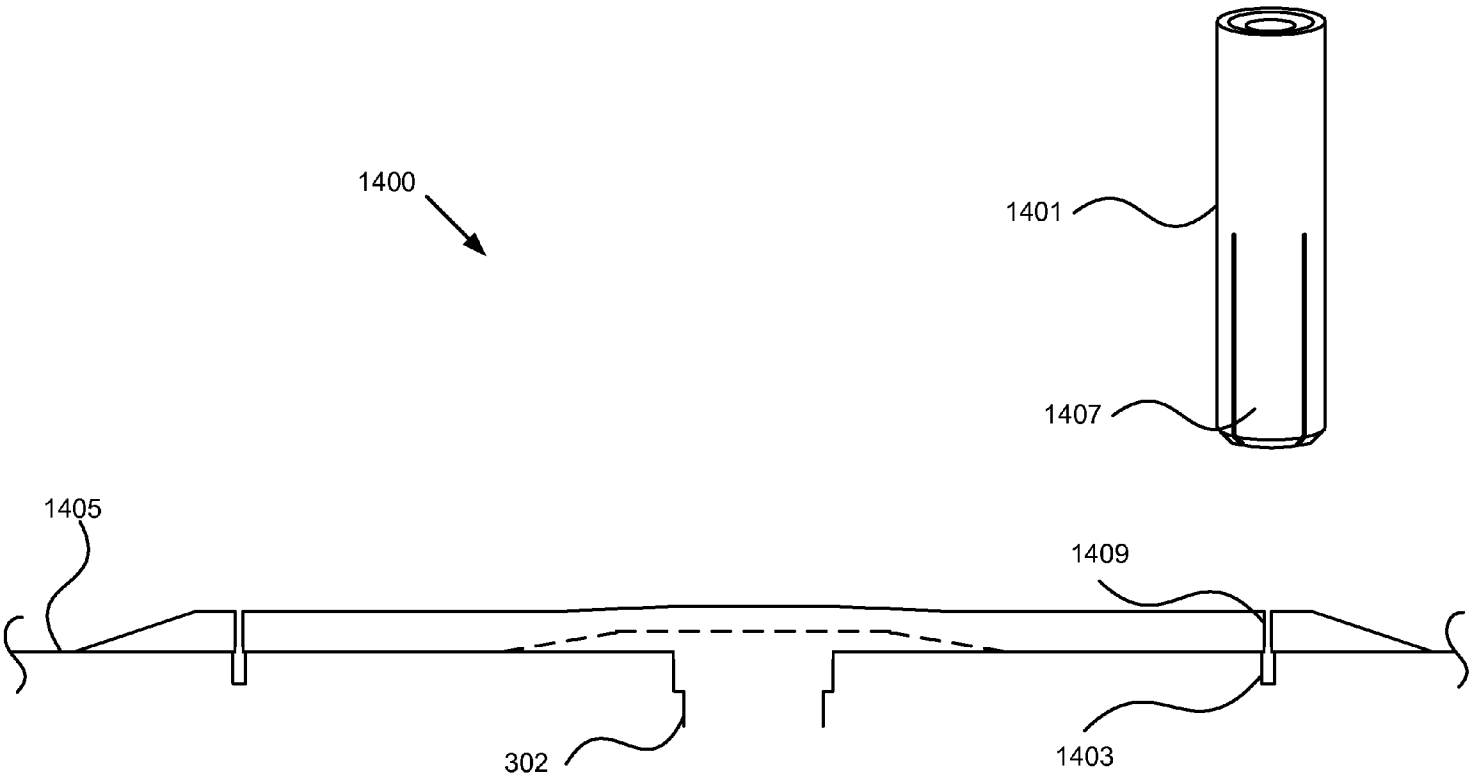
FIG. 14 is a cutaway side view of circular cover housing in which the cover housing is secured to a pool floor through the use of drop-in anchors.

Under certain embodiment, such as that of FIGS. 12, 13 and 14, the flat region 204*a*-204*d* contains a lid 206. The lid may be removable to allow the user to access the pool drain. Under certain embodiments, the lid 206 locks into place when secured.

The ramp 202*a*-202*d*, circumscribes the perimeter of the cover 200 and rises at a gentle grade to allow a common pool cleaning vacuum to pass over the top. An example of a sufficiently gentle grade is 18.4 degrees, produced by a rise of 2 inches in a run of 6 inches. Variations with more gradual grades and with steeper grades may also be used. A rise of at least 2 inches is advantageous in some embodiments so that the cover 200 may house various tubes 308 depicted in FIG. 3, as discussed below.

In certain embodiments, the cover 200 may include a seal 206*a*-206*d*. The seal 206*a*-206*d* circumscribes the perimeter of the cover 200 at its base, or a region near the perimeter, to prevent the flow of pool water. In one embodiment, the seal 206*a*-206*d* might be formed with neoprene. In another embodiment, the seal 206*a*-206*d* might be formed with silicone. Other materials for the seal 206*a*-206*d* are also possible. Under another embodiment, the seal 206*a*-206*d* circumscribes the perimeter of the cover 200, under the cover 200. In this embodiment, the seal 206*a*-206*d* is pressed between the cover 200 and a pool floor of a pool.

Figure 2F:
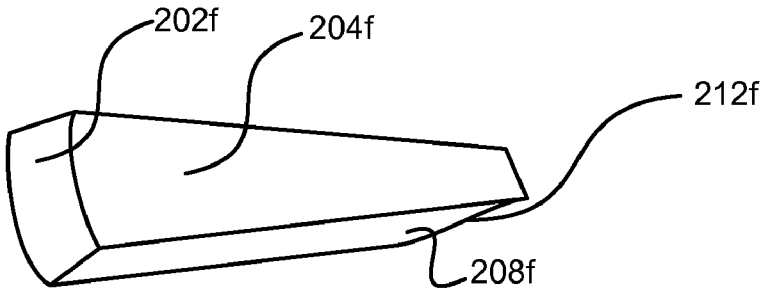

The cover 200 may be of any of the shapes depicted in FIGS. 2*a* through 2*e* or any other shape and may be comprised of segments substantially similar to the segment depicted in FIG. 2*f*. FIG. 2*f* depicts a cover segment for a circular cover 200 similar to that depicted in FIG. 2*a*. The segment 2*f* includes a ramp 202*f* substantially similar to the ramps 202*a*-202*d* depicted in FIGS. 202*a*-202*d*. The segment 2*f* also includes a flat region 204*f* substantially similar to the flat region 204*a*-204*d* depicted in FIGS. 202*a*-202*d*. Additionally, the segment 2*f* has a sloping end 212*f* that moves away from the ramp 202*f* side of the segment as it rises at an angle to the flat region 204*f*. The segment 2*f* may have sidewalls 208*f* or may be a substantially solid block housing tubes such as those depicted in FIG. 6.

Figure 2G:
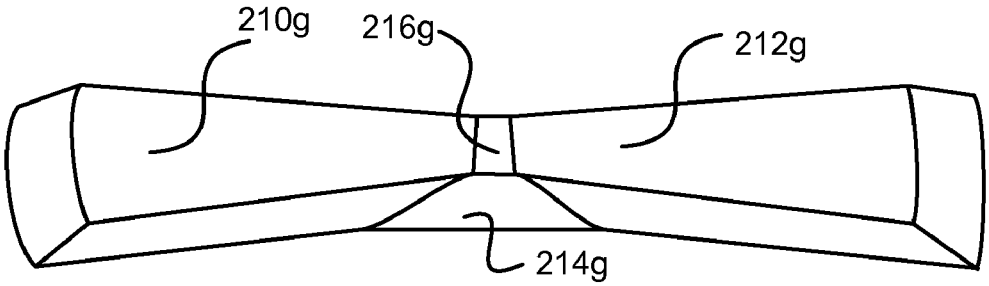

In certain embodiments, a first cover segment 210*g* similar to the cover segment depicted in FIG. 2*f* may be combined with a second cover segment 212*f*, also similar to the cover segment depicted in FIG. 2*f*, to form the double segmented cover depicted in FIG. 2*g*. The double segmented cover depicted in FIG. 2*g* includes connecting paneling 214*g*, which may also include a top connecting plate 216*g*. In certain embodiments, the connecting paneling 214*g* and the top connecting plate 216*g* may snap into place or may be glued in place. A cavity (similar to 302 of FIG. 3) is formed over the pool drain (see 302 of FIG. 3) by the top connecting plate 216*g*, the opposing slopping ends 212*f* of the first cover segment 210*g* and the second cover segment 212*g*, and the connecting paneling 214*g*.

Figure 2H:
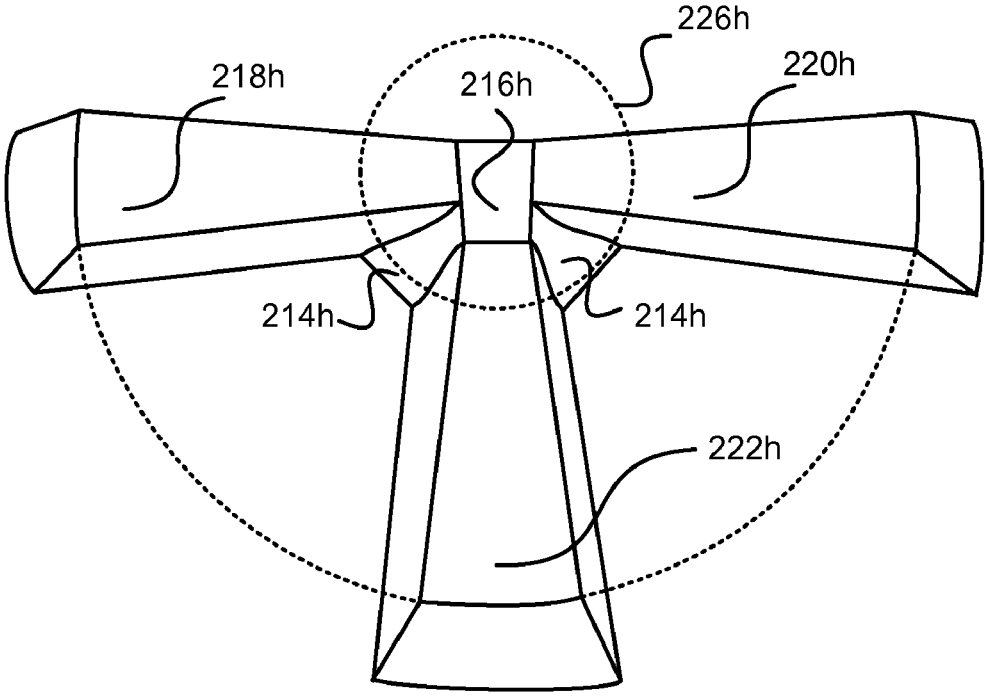

In additional embodiments, multiple cover segments 218*h*, 220*h*, 222*h* similar to the cover segment depicted in FIG. 2*f* may be combined to form the multiple segmented cover depicted in FIG. 2*h*. The multiple segmented cover FIG. 2*h* includes three pieces of connecting paneling 214*h* and a top connecting plate 216*h*. The shape of the top connecting plate 216*h* and the pieces of connecting paneling 214*h* allows the multiple segmented cover depicted in FIG. 2*h* to seal off a cavity (similar to 302 of FIG. 3) over the pool drain (see 302 of FIG. 3).

In embodiments comprising a sufficient number of cover segments FIG. 2*f*, the multiple segmented cover depicted in FIG. 2*h* is of the full circular shape depicted in FIG. 2*c*. Depending on the embodiment, the segmented cover depicted in FIG. 2*h* may be of any shape depicted in FIGS. 2*a* through 2*e*, or of additional shapes. In embodiments with a sufficient number of cover segments FIG. 2*f*, the cover segments FIG. 2*f* are placed side by side, and there is no need for connecting paneling 214*g*, 214*h*.

Figure 3:
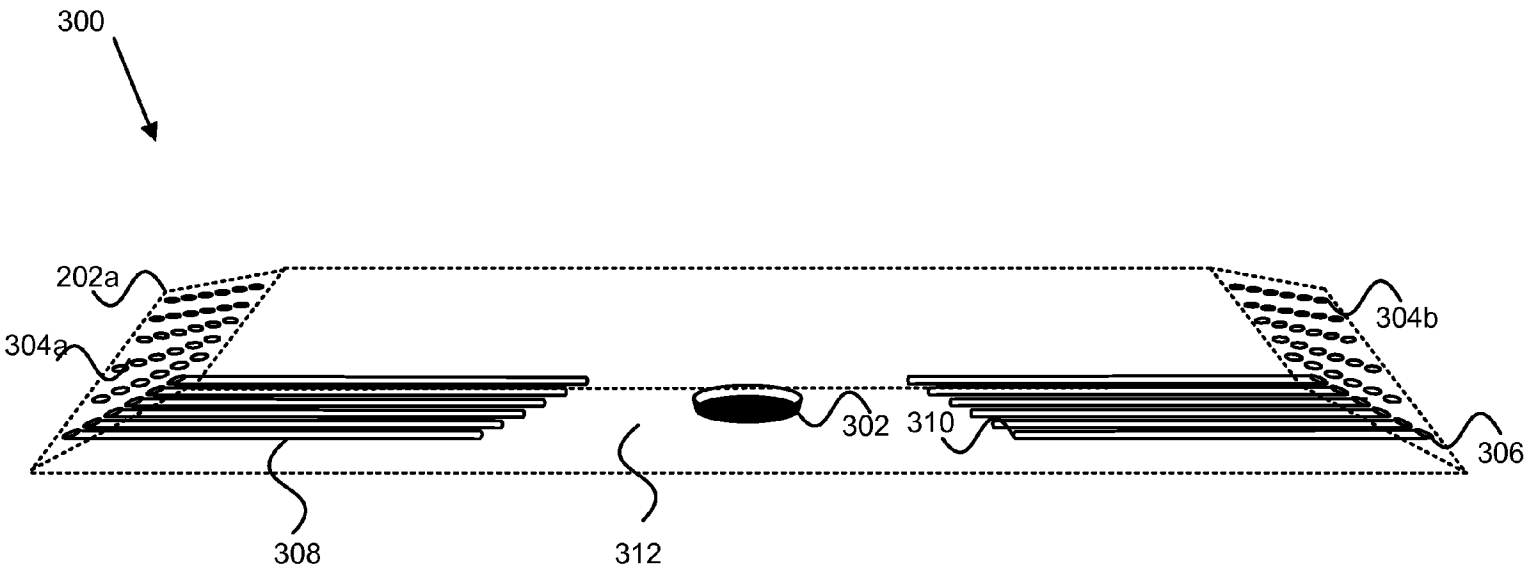
FIG. 3 is a phantom, perspective view of a rectangular cover housing straight, horizontally disposed tubes circumscribing channels with substantially continuous cross-sectional areas, in accordance with one embodiment of the present invention.

The top connecting plate 216*h*, in addition to the opposing slopping ends 212*h* enclose the cavity (similar to 302 of FIG. 3) above the pool drain (see 302 of FIG. 3). In an embodiment where the multiple segmented cover depicted in FIG. 2*h* is of the full circular shape, the top connecting plate 226*h* is a circle. The cavity (similar to 302 of FIG. 3) enclosed thereby has the shape of a truncated cone, the sidewalls of the cone being formed by the opposing slopping ends 212*f* and the cone shape being truncated by the top connecting plate 226*h*.

Depending on the embodiment, the cover segments FIG. 2*f* may be snapped together, glued together, or otherwise connected by a manner recognizable by those of ordinary skill in the art. The cover 200 may be formed from a thermoplastic by injection molding, from a thermoplastic by thermoforming, or from thermosetting resin or a thermoplastic by compression molding, extrusion or any other method recognizable by those of ordinary skill in the art. The cover 200 could also be made of a metal material or any other material.

Referring now to FIG. 3, which depicts an apparatus 300 for housing straight, horizontally disposed tubes 308, circumscribing channels with substantially continuous cross-sectional areas, toward the center of the rectangular cover depicted in FIG. 2*a*. FIG. 3 depicts a phantom, perspective view of the rectangular cover 200 depicted in FIG. 2*a*, centered over a pool drain 302. A series of apertures 304*a*, 304*b* occupy the perforated ramp 202*a* as it extends across the two opposing short sides of the rectangular cover 200.

The apertures 304*a* and 304*b* may be circular, elliptical, or of any geometric shape. Furthermore, the apertures 304*a* and 304*b* may be arranged in rows and columns, in a circle, offset from one another, or any conceivable pattern. In one embodiment, the number of rows is equal to 6. The apertures 304*a* and 304*b* may be created by drilling or puncturing the cover 200, or may be provided for in the molding process.

Although the various perimeters and cross-sectional areas of apertures 304*a*-304*b* may differ, in certain embodiments the cross-sectional area of each aperture 304 is small enough to prevent a small child from inserting a finger or toe in the aperture 304. A diameter of ¼ inch for an embodiment with a circular or elliptical aperture provides an example that meets this condition. In other embodiments, with larger apertures, a grid or a mesh may be used to prevent a small child from inserting a finger or toe in the aperture 304.

A distal opening 306 of a horizontally disposed tube 308 may connect to each of the apertures 304*a* and 304*b*. The interior of each tube 308 circumscribes a channel extending the length of the tube 308 from a distal opening 306 to the proximate opening 310 discussed below. The distal opening 306 of the tube 308 is at an end distal to the center of the cover 200. In certain embodiments, the perimeter of the distal opening 306 coincides with the perimeter of the aperture 304 to which it connects and may be circular, elliptical, square, or any other shape.

Similarly, a cross section of the tube 308 may be circular, elliptical, square, or any other shape and may vary from point to point. The tube 308 may be welded to the perforated ramp 202*a*, affixed with an adhesive, molded, secured with braces and pins, or fixed with a mechanical device for snapping, locking, or screwing, so that the center of the distal opening 306 and the center of its corresponding aperture 304 substantially coincide.

The tube 308 is substantially straight. The proximate opening 310 of the tube 308 is directed toward the center of the apparatus 300. The proximate opening 310 of the tube 308 may be circular, elliptical, square, or any other shape and the perimeter of the proximal opening 310 need not coincide with the perimeter of the distal opening 306. Furthermore, the proximate openings 310 of the various tubes 308 may be offset from one another, some extending further to the center of the apparatus 300, as depicted in FIG. 3. The proximate opening 310 of each tube 308 is disposed within the interior of the cover 200 and is proximate to the other openings of other tubes 308 at the ends of those tubes 308 closest to the center of the cover 200.

The substantially straight tubes 308 result in a laminar flow of fluid toward the pool drain 302 that mitigates the formation of turbulence. By mitigating turbulence, the tubes typically prevent hair, jewelry, or clothing from becoming caught or entangled within the interior of the cover 200 and entrapping a victim. Hair, jewelry, and/or clothing are known to enter the apertures of pool drains and become entangled on the other side of pool drain apertures in currents resulting from a vortex or turbulence. The tubes 308 of the present invention substantially prevent such entanglements. The seal 206*a*-206*e* around the perimeter of the cover 200 also prevents hair, jewelry, and/or clothing from getting caught by the cover 200.

Tubes 308 of various lengths are possible. Tubes 308 of greater length maximize laminar flow. However, tubes 308 of various lengths are consistent with the present invention. In certain embodiments, tubes 308 of 6 to 12 inches may be used to enhance laminar flow and safety. Tubes of greater length will further enhance laminar flow and safety.

Even with tubes 308 that are 12 inches or longer, strands of hair or other items may travel the length of such tubes 308. Therefore, in certain embodiments, a large center cavity 312 separates the proximate openings 310 of the tubes 308. The area of this center cavity 312 may be described by the distance between the various proximal openings 310. In certain embodiments the distances may be in the range of 6 to 24 inches. However, other distances are possible.

Tube lengths of 6 to 12 inches and distances between proximal openings 310 of 6 to 24 inches create large diameters, lengths, and widths for covers 200. However, large diameters, lengths, and widths are desirable to increase the surface area over which apertures 304 may be arranged. As apertures 304 increase in number and are located over a larger area, the likelihood that a victim will cover all, or enough, apertures 304 to feel the pressure of a vacuum generated by the pool drain 302 decreases. The foregoing consideration also suggests larger runs, such as six inches, on the ramp 202*a*-202*e* of the cover 200.

Depending on the manner in which the tubes 308 are affixed to the perforated ramp 202*a*, additional support may be desirable for the 308 tubes. As appreciated, in several embodiments, tubes 308 are in close proximity to one another. Therefore, in certain embodiments, the additional support may be provided by a latticework extending from tube 308 to tube 308 and down and to the base of the pool on which the apparatus 300 rests. The tubes 308 may be held in place by friction between the latticework and the tubes 308, with an applied to the latticework and the tubes 308, by a mechanical device that snaps each tube 308 to the latticework, or the like. In one embodiment, the tubes 308 may even be drilled into a single block of material or may be provided for in the molding process, taking the place of the latticework and removing the need for a latticework. In such embodiments, the tubes 308 are considered to be the sidewalls of the channels drilled into or provided for in the molding process for the material of cover 200.

Figure 4:
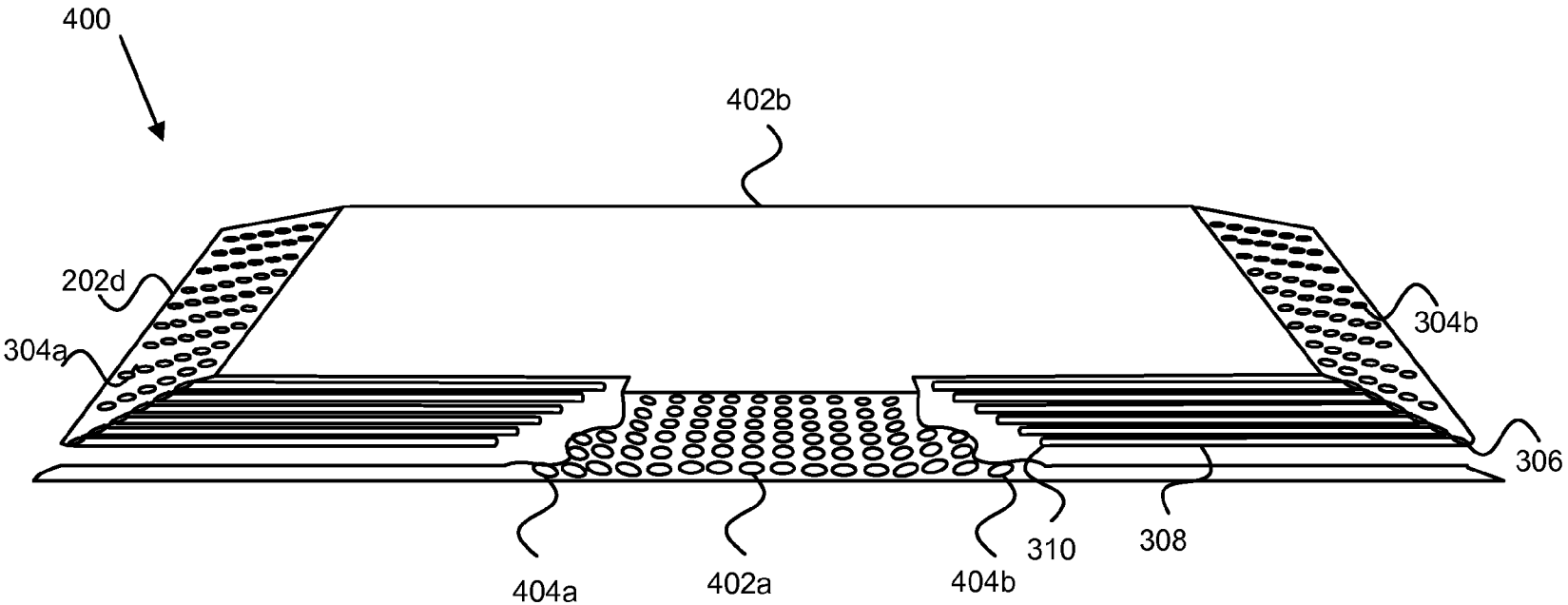
FIG. 4 is a cutaway, perspective view of straight, horizontally disposed tubes circumscribing channels with substantially continuous cross-sectional areas, the tubes coupled to all 4 sides of the square cover in accordance with another embodiment of the present invention.

Referring now to FIG. 4, which depicts an apparatus 400 for housing straight, horizontally disposed tubes 308, circumscribing channels with substantially continuous cross-sectional areas, toward the center of the apparatus 400 and entering the apparatus from all 4 sides of a square 400. FIG. 4 depicts a cutaway, perspective view of horizontally oriented tubes 308 coupled to the sides of the square cover depicted in FIG. 2*d*. The rectangular apparatus 300 and the square apparatus 400 both depict tubes 308 entering from two opposite sides of their respective structures. In both the rectangular apparatus 300 and the square apparatus 400, apertures 304*a*, 304*b* of any shape occupy the perforated ramps 202*a*-202*d* rising from the two opposite sides of their respective structures. In both the rectangular apparatus 300 and the square apparatus 400, the center of distal openings 310 of several tubes 308 coincide with the center of the apertures 304*a* and 304*b*, the tubes 308 being affixed to the perforated ramps 202*a*-202*d*.

However, in the square apparatus 400, a second set of apertures 402*a*-402*b* also occupy the remaining pair of opposing sides. An additional set of tubes 308 is coupled to this second set of apertures 402*a*-402*b*, resulting in tubes horizontally disposed toward the center of the square apparatus 400 from all four of its sides. In the case of a square cover 200, however, the second set of apertures 402*a*-402*b* and of tubes 308 are not arranged all the way across the remaining pair of opposing sides, but are centered to avoid tubes 308 from the first pair of opposing sides from occupying the same space as tubes 308 from the remaining pair of opposing sides. Therefore, there are two outermost bands 404*a*-404*b* of apertures 402*a*-402*b*, arranged in the remaining pair of opposing sides.

In a circular cover, however, such as the one shown in FIG. 2*c*, apertures 304 may occupy completely the perforated ramp 202*c* along the perimeter of the cover 200 without the tubes 308 corresponding to the apertures 304 occupying the same space. The ability of tubes 308 to be arranged all along the ramp 202*c*, from all three-hundred and sixty degrees, provides an advantage that makes circular ramps 202*c* an attractive option.

Figure 5:
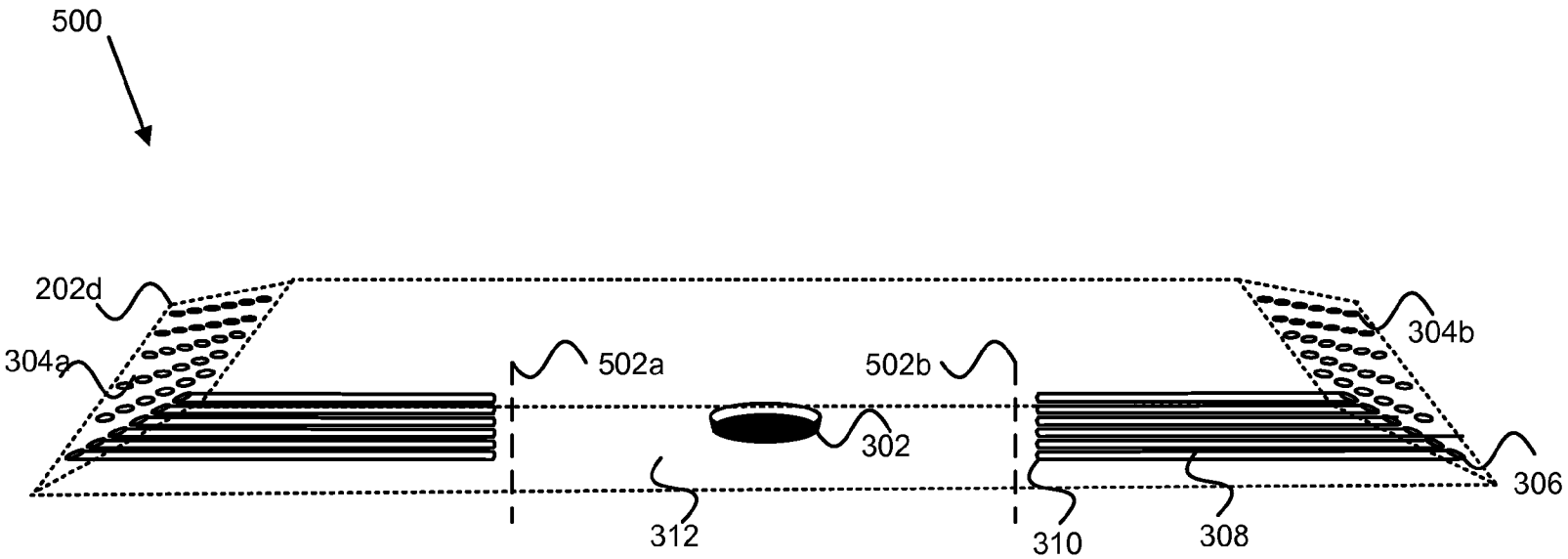
FIG. 5 is a phantom, perspective view of a rectangular cover housing straight, horizontally disposed tubes circumscribing channels with substantially continuous cross-sectional areas, the tubes' interior openings are cut to line up along vertical axes equidistant from a pool drain.

Referring now to FIG. 5, which depicts an apparatus 500 for housing straight, horizontally disposed tubes 308, circumscribing channels with substantially continuous cross-sectional areas, whose inner openings are cut to line up at a point equidistant from the main drain on a horizontal axis. In FIG. 5, the phantom, perspective view is of a rectangle cover depicted in FIG. 2*a*. This cover 200 houses horizontally oriented, substantially straight tubes 308 affixed to a perforated ramp 202*a* on opposing sides of the rectangular structure, to coincide with apertures 304*a*-304*b* occupying that ramp 202*a*. The proximate openings 310 of those tubes 308 are cut to line up along two vertical axes 502*a*-502*b*, one for each of the two opposing sides.

The length of each tube 308 may be the same as the length of every other tube 308, as in apparatus 300 and apparatus 400. The length of one tube 308 may also vary from the length of another tube 308, as in apparatus 500. As discussed, the tubes 308 may be of any shape and may have cross sections that vary from point to point. The tubes 308 may even be bent, as long as their proximate openings 310 are made proximate to each other by being directed to the center of the cover 200 that houses them.

Figure 6:
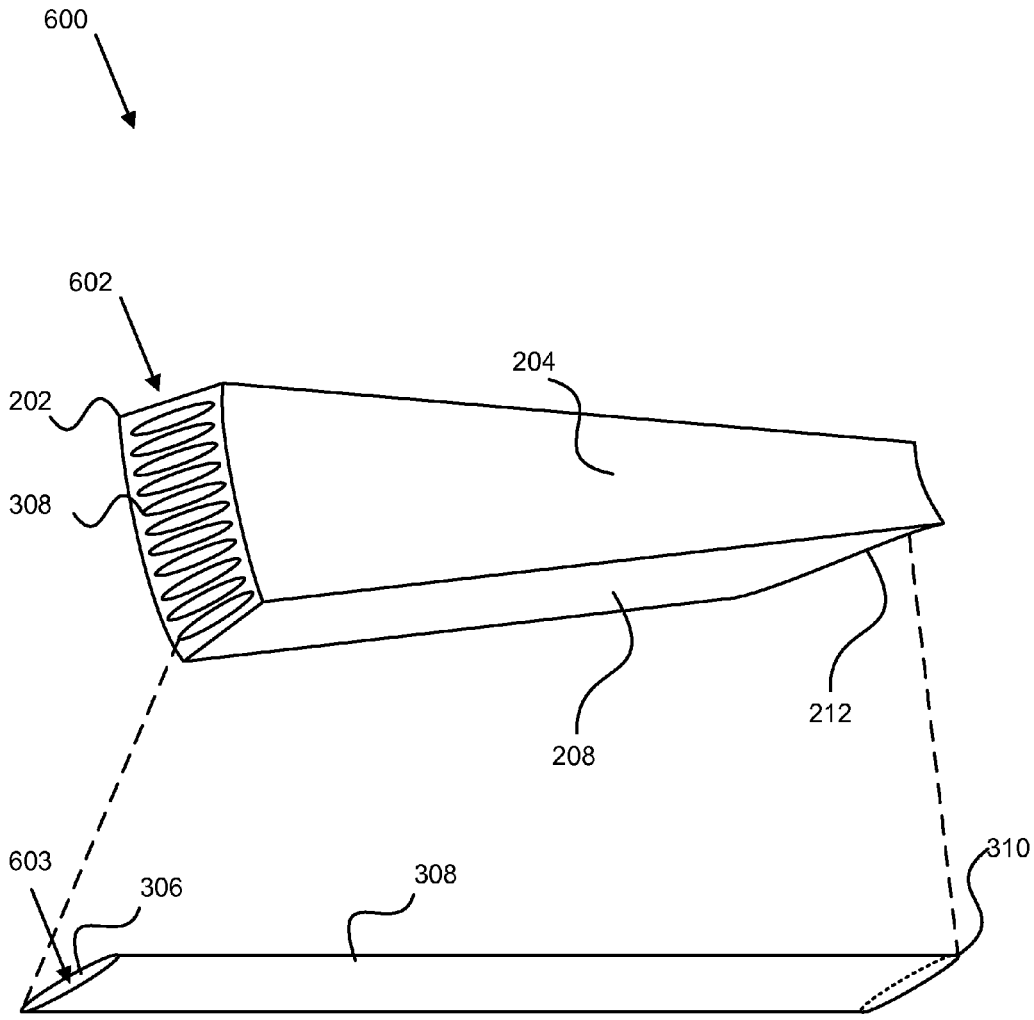
FIG. 6 is perspective view of a single cover segment with a single row of straight, horizontally disposed tubes circumscribing channels with substantially continuous cross-sectional areas, with an exploded view of a particular tube with an elliptical channel extending the length of the tube.

Referring now to FIG. 6, which depicts a perspective view of a single cover segment 600 with a single row of straight, horizontally disposed tubes 308, circumscribing channels with substantially continuous cross-sectional areas, with an exploded view of a particular tube with an elliptical channel extending the length of the tube. The single cover segment 600 is similar to the cover segment depicted in FIG. 2*f* and includes a section of ramp 202 substantially similar to the ramps 202*a*-202*d*, depicted in FIGS. 202*a*-202*d*. The cover segment 600 also includes a flat region 204 substantially similar to the flat region 204*a*-204*d* depicted in FIGS. 202*a*-202*d*.

Additionally, the cover segment 600 has a sloping end 212 that moves away from the ramp 202 side of the segment as it rises at an angle to the flat region 204. The sloping end 212 may rise in straight or curving fashion. Additionally, the slopping end 212 may reflect the curvature of the perimeter of the ramp 202 or it may be straight.

The cover segment 600 has sidewalls 208 formed from a substantially solid block housing a single row 602 of tubes 308 drilled into a single cover segment 600 or provided for in the molding process. FIG. 6 includes an exploded view of a particular tube 308, from the interior of the cover segment 600. The particular tube 308 has a distal opening 306 in the ramp 202 and a proximate opening 310 in the slopping end 212 that rise at angles which may be commensurate with the ramp 202 and the slopping end 212 respectively.

Both the distal opening 306 and the proximate opening 310 have elliptical cross sectional areas. An elliptical channel 603 extends the length of the tube 308 between the distal opening 306 and the proximate opening 310. The elliptical channel 603 is substantially straight with substantially continuous cross-sectional areas, facilitating laminar flow. Since the cover segment 600 is a wedge from a circular shape, the tubes 308 and their elliptical channels 603 therein may have some slight tapering.

However, by making the distal openings 306 and the proximate openings 310 have elliptical cross sectional areas and increasing the ratio of the major axis (see 702 of FIG. 7) to the minor axis (see 704 of FIG. 7), the degree of tapering can be greatly reduced. Additionally, the distance between the distal openings 306 of two tubes 308 and the distance between the proximate openings 310 may be varied. By increasing the ratio of the major axis (see 702 of FIG. 7) to the minor axis (see 704 of FIG. 7) or the elliptical channels 603, a greater number of tubes 308 and channels 603 may be included along the ramp.

A larger number of tubes 308 and channels 603 make it less likely that one or more individuals and/or their clothing will block enough channels to result in suction entrapment. Additionally, the resulting cross sectional areas are less likely to admit jewelry and clothing and will admit less hair. The less material that it is admitted, the less likely that the material will anchor an individual and the easier that the material may be extracted or severed. Furthermore, straight, horizontally disposed tubes 308, circumscribing channels 603 with substantially continuous cross-sectional areas, in laminar flows that are less likely to entangle and lodge materials in the channels 603.

Figure 7A:
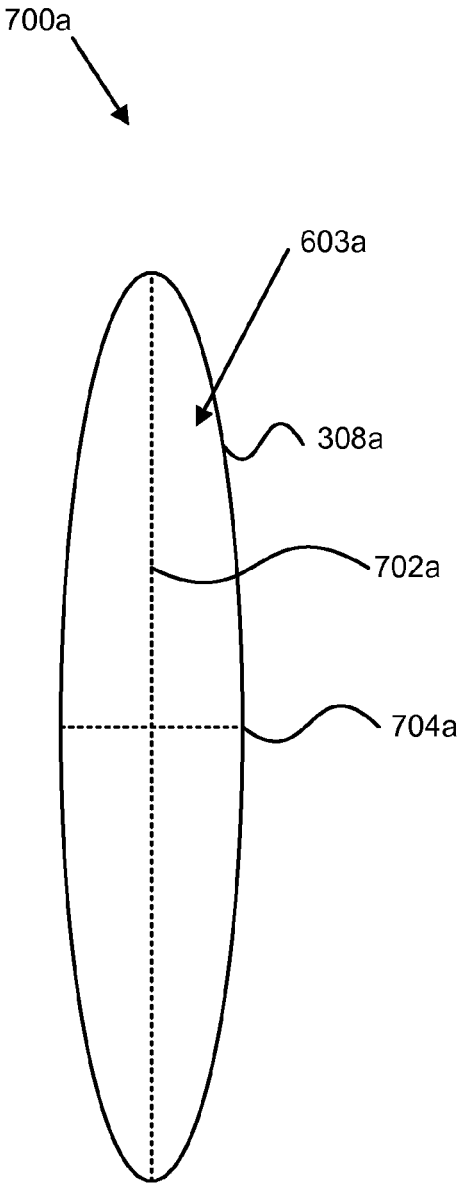
FIG. 7*a* and FIG. 7*b* depict two alternate frontal views of the cross-sectional area of alternate elliptical channels.

Referring now to FIG. 7*a*, which depicts a frontal view of the cross-sectional area 700*a* of a first elliptical channel 603*a*. In FIG. 7*a*, an elliptical channel 603*a* is circumscribed by a tube 308*a*. The cross-sectional area 700*a* of the elliptical channel 603*a* has a major axis 702*a* and a minor axis 704*a*, wherein the length of the major axis 702*a* is much greater than that of the minor axis 704*a*. The shape of the cross-sectional area 700*a* of the elliptical channel 603*a* is similar to that of a formal ellipse.

Figure 7B:
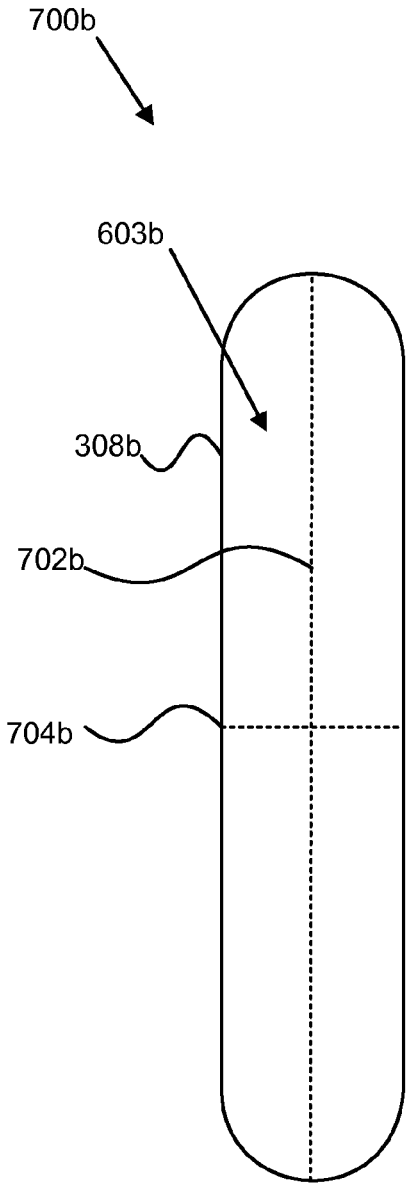

Referring now to FIG. 7*b*, which depicts a frontal view of the cross-sectional area 700*b* of a second elliptical channel 603*b*. In FIG. 7*b*, an elliptical channel 603*b* is circumscribed by a tube 308*b*. The cross-sectional area 700*b* of the elliptical channel 603*b* also has a major axis 702*b* and a minor axis 704*b*, wherein the length of the major axis 702*b* is much greater than that of the minor axis 704*b*. However, the shape of the cross-sectional area 700*b* of the elliptical channel 603*b* is not a traditional ellipse, but more of a rectangle with rounded ends. FIGS. 7*a* and 7*b* are, therefore, provided in part to demonstrate that for purposes of this application an elliptical channel 603 can have a cross sectional area that is substantially similar to a traditional ellipse or an oblong shape with rounded ends at the ends of a major axis 702*b*.

Figure 8A:
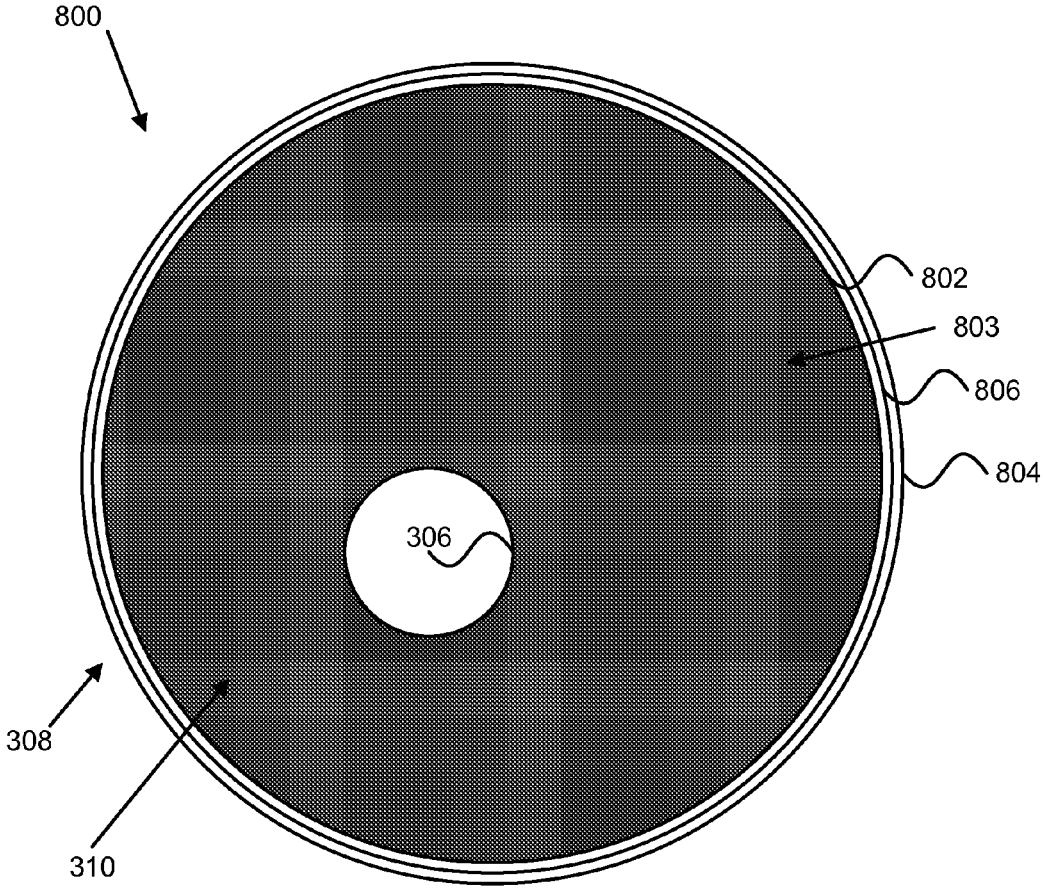
FIG. 8*a* is a frontal perspective view of a tube end tapered to a cutting edge, in accordance with the present invention.

Referring now to FIG. 8*a*, which depicts a cutting edge 800 for cutting hair, clothing, jewelry and other items. FIG. 8*a*, is a frontal perspective view of a tube tapered to a cutting edge. As discussed, even with tubes 308 that are 12 inches or longer, strands of hair or other items may travel the length of such tubes 308. Such items may become entangled within the cover, entrapping a victim to whom they are attached. The cutting edge 800 provides an approach for cutting away such entangled items so that a formerly entrapped victim may escape.

A tube 308 has a sidewall with an inner diameter 802, which describes the channel 803 within the tube, and an outer diameter 804. The sidewall is tapered from the inner diameter 802 and the outer diameter 804 to terminate at the proximal opening 310 of the tube 301 at a cutting edge 806. The cutting edge 806 allows a victim to sever any entangled material trapping the victim to the cover 200. In certain embodiments the inner diameter 702 is tapered at a greater rate than the outer diameter 804, or vice versa. In some embodiments only the inner diameter 802 or only the outer diameter is tapered.

Figure 8B:
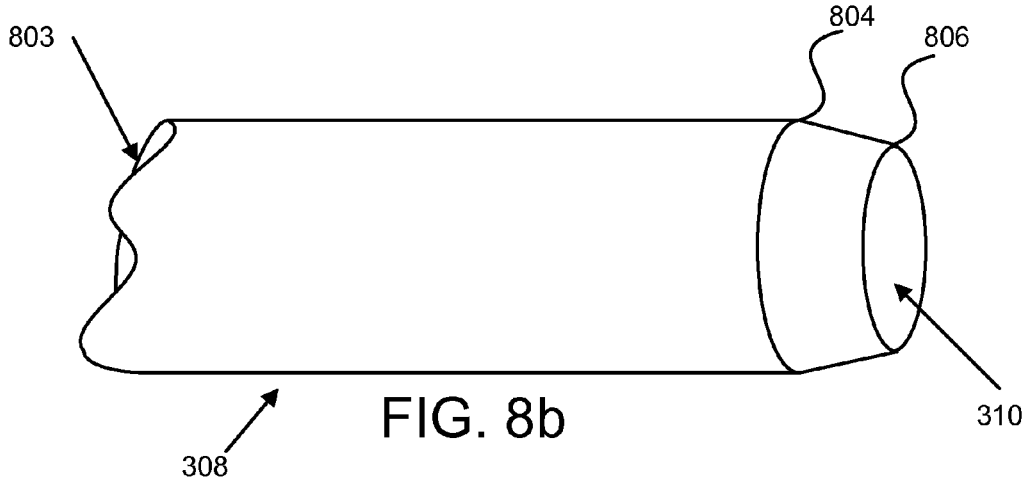
FIG. 8*b* is a side perspective view of a tube end tapered to a cutting edge, in accordance with the present invention.

FIG. 8*b* provides another view of the cutting edge 800. FIG. 8*b* is a side perspective view of a tube tapered to a cutting edge. The Figure shows a tube 308 and an outer diameter 804 of a sidewall that terminates at the proximal opening 310 of the tube 308. The outer diameter 804 is tapered to a cutting edge at the proximal opening 310.

Figure 9:
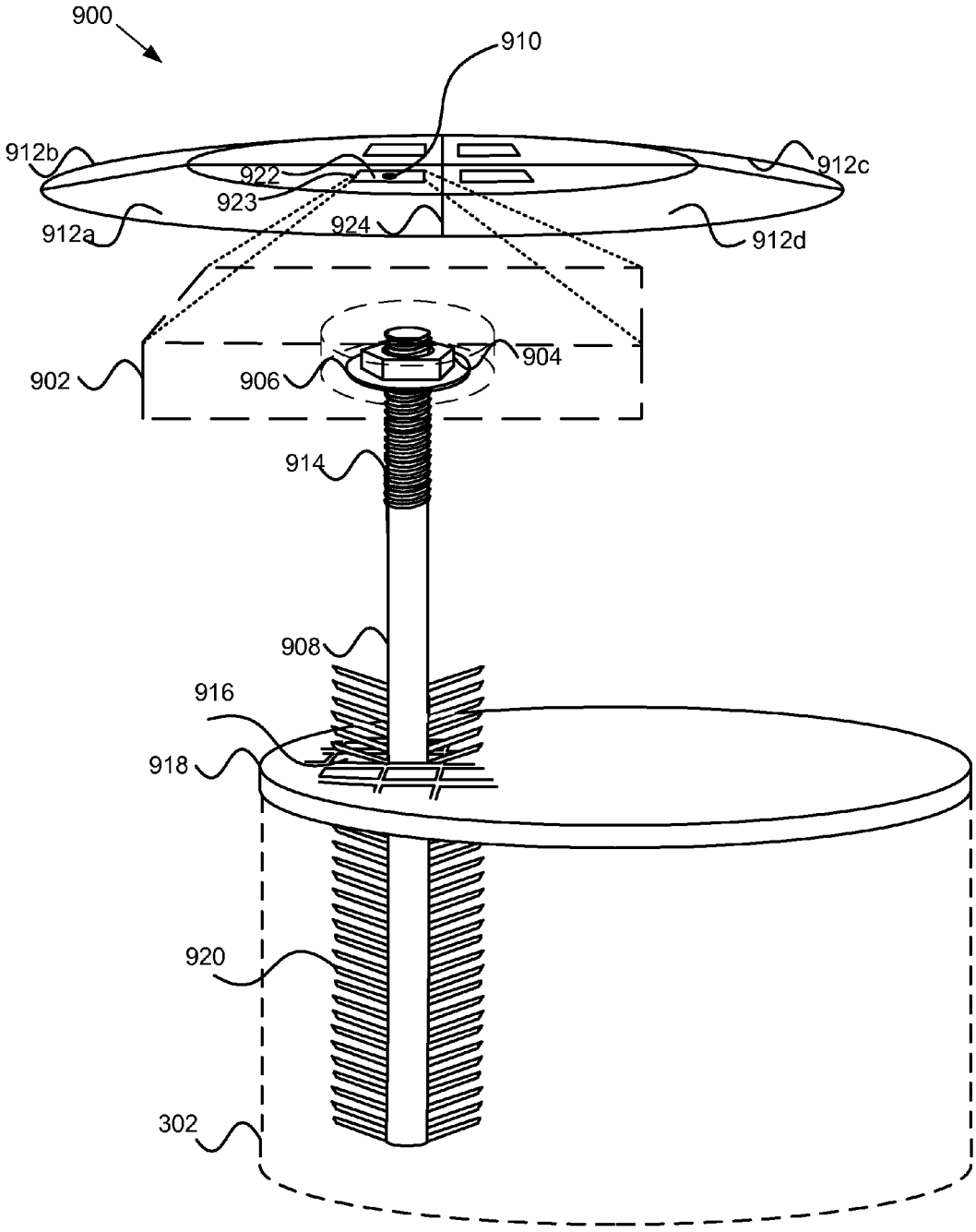
FIG. 9 is an exploded, phantom, perspective view of a cover, plastic, push-in fastener affixing the present invention to a preexisting main drain, where the cover snaps into place in one segment of a segmented cover, in accordance with the present invention.

Referring now to FIG. 9, which depicts an apparatus 900 for a segmented cover attached to a main drain by covered plastic, push-in fasteners. FIG. 9 depicts an exploded, phantom, perspective view of a covered, plastic, push-in fastener that affixes certain embodiments of the present invention to a preexisting, pool drain 302. In certain embodiments, a cap 902 may cover a nut 904, a washer 906, and a plastic, push-in fastener 908.

The plastic, push-in fastener 908 may pass through an aperture 910 in one of four segments 912*a* of the cover 200. In certain embodiments, there may be more or less than four segments 912. In embodiments with a top connecting plate 216*g*, 216*h*, 226*h*, similar to those depicted in FIGS. 2*g* and 2*h*, all four apertures 910 are found in the same top connecting plate 216*g*, 216*h*, 226*h*.

The nut 904 may be threaded onto the threads 914 of the plastic, push-in fastener 908 and rests atop the washer 906, the nut 904 and the washer 906 having diameters greater than that of the aperture 910, preventing the plastic, push-in fastener 908 from passing down through the aperture 910. In other embodiments, the plastic, push-in fastener 908 has an enlarged top region that presents the plastic, push-in fastener 908 from passing down through the aperture 910.

Several collapsible prongs 920 of the plastic, push-in fastener 908 are passed through a rectangular slot 916 in a grid 918 attached to a pool drain 302. The collapsible prongs 920 of the plastic, push-in fastener 908 are passed through the rectangular slot 916 of the grid 918 until the segment 912*a* is firmly attached to the grid 918, which is in turn affixed to the pool drain 302.

In certain embodiments, lag bolts may replace the plastic, push-in fasteners 908 as the approach for attaching the cover 200. In other embodiments, hooks or j-bolts may be threaded through the grid 918.

Under the embodiment of FIG. 14, drop-in anchors 1401 are used to secure a pool drain cover 1400 above the pool drain 302. The drop-in anchors 1401 are preferably treaded through the interior of the drop-in anchor 1401. A bottom portion 1407 of the drop-in anchor 1401 contains slots that allows the bottom portion 1407 to expand as a screw is threaded into the threading of the interior of the drop-in anchor 1401, or when a setting tool is used to set the drop-in anchor 1401. The slots may be linear, triangular, rectangular, wavy or any other shape that allows the bottom portion 1407 to expand. Openings 1403 are placed in a pool floor 1405 that are preferably of a slightly larger diameter and shape than the drop-in anchors 1401. The drop-in anchors 1401 preferably fit tightly in the openings 1403. Under one embodiment, the drop-in anchors 1401 fit tightly enough in the openings 1403 to create a friction fit. Under another embodiment, the drop-in anchors 1401 fit loosely in the openings 1403. Under different embodiments, the openings 1403 in the pool floor 1405 and the drop-in anchors 1401 can be square, rectangular or any other shape. The openings 1403 in the pool floor 1405 preferably extend the distance of the height of the drop-in anchors 1401. When installed in the openings 1403, the drop-in anchors 1401 should preferably be substantially contained within the openings 1403.

Under one embodiment, the drop-in anchor 1401 contains a knurled surface to help it secure to the opening 1403. One skilled in the art will recognize several other surface treatments possible to help secure the drop-in anchor 1401 in the opening 1403.

Securing openings 1409 are disposed in the pool drain cover 1400. The securing openings 1409 are preferably smaller than the drop-in anchors 1401 and the openings 1403 disposed in the pool floor 1405. Under one embodiment, the securing openings 1409 are sized to allow passage of a screw. Under another embodiment, the securing openings 1409 contain a thread similar to the tread disposed in the drop-in anchors 1401. This allows a screw to thread through the securing openings 1409 as well as the drop-in anchors 1401. The drop-in anchors 1401 are placed in the openings 1403 in the pool floor. The pool drain cover 1400 is placed on the pool floor 1405 and the securing openings 1409 are aligned with the openings 1403 in the pool floor 1405. Under one embodiment, screws are placed through the securing openings 1409 and threaded into the drop-in anchors 1401. When the screws enter the drop-in anchors 1401, the drop-in anchors 1401 expand. The expansion of the drop-in anchors 1401 creates pressure between the drop-in anchors 1401 and the openings 1403 disposed in the pool bottom. This pressure preferably secures the drop-in anchors 1401 to the openings 1403 disposed in the pool bottom 1405. Under other embodiments, devices other than screws are placed through the securing openings 1409 and into the drop-in anchors 1401 including cotter pins, bolts, nails, or any other device that can be placed through the securing openings 1409 and into the drop-in anchors 1401.

Under one embodiment, the drop-in anchors 1401 remain permanently secured to the openings 1403 once the drop-in anchors 1401 have been expanded and secured. Under one embodiment, the drop-in anchors 1401 are made of a metal material. Under another embodiment, the drop-in anchors 1401 are made of a hard plastic material. One skilled in the art will recognize that the drop-in anchors 1401 can be made of a plurality of materials.

The pool drain cover 1400 may contain any number of openings. Under one embodiment, the pool drain cover 1400 is segmented and contains one opening in each segment. Under another embodiment, the pool drain cover 1400 is segmented and contains a plurality of openings in each segment.

Other known methods for affixing the pool drain cover 1400 above the pool drain 302 will also be apparent to those skilled in the relevant art in light of this disclosure.

The cap 922 enclosing the nut 904, the washer 906, and the plastic, push-in fastener 908, may fit snuggly into a well 923 surrounding the aperture 910 and housing the nut 904, the washer 906, and the plastic, push-in fastener 908. The cap 922 may snap into place, may lock into place by a mechanical device, or may be screwed into place, but a means must exist for removing the cap 922. The cap 922 may be made of the same material as the cover segment 912, or may be made of a different material, such as synthetic or natural rubber. Once in place, the cap 922 should be waterproof with relation to the well 923. Under another embodiment, the cap 922 is not waterproof but the nut 904, the washer 906, and the plastic, push-in fastener 908 are waterproof.

FIG. 9 depicts a circular cover, also depicted in FIG. 2*c*. However, FIG. 6 divides the cover 200 into four equal segments 912*a*, 912*b*, 912*c*, 912*d*. Dividing the cover 200 into segments is desirable for several reasons. As discussed, the diameter of a cover 200 can be quite large, making the cover 200 heavy and awkward to work with and to transport. Dividing a cover 200 into several segments mitigates these problems.

FIG. 9 depicts 4 equal segments. However, the cover 200 may be divided into any number of segments along cuts 924 made in any number of ways. The segments may be snapped together, may be locked into place by a mechanical device, may be screwed together, or the like. The joints between the segments may be strengthened with tongues and groves or other interlocking arrangements.

Each segmented cover with an aperture 910 and a well 922 may be reinforced in the region of the aperture 910 and the well 922. Typically, not all segments need to be secured with a plastic, push-in fastener 908 if they are sufficiently connected to any segment 912 that is connected with a plastic, push-in fastener 908. Corrugations of various thicknesses and patterns, depending on the material from which the cover 200 is formed, may reinforce the region of the aperture 910 and the well 922. In embodiments with a top connecting plate 216*g*, 216*h*, 226*h*, similar to those depicted in FIGS. 2*g* and 2*h*, all apertures 910 and wells 922 are found in the same top connecting plate 216*g*, 216*h*, 226*h*.

Figure 10:
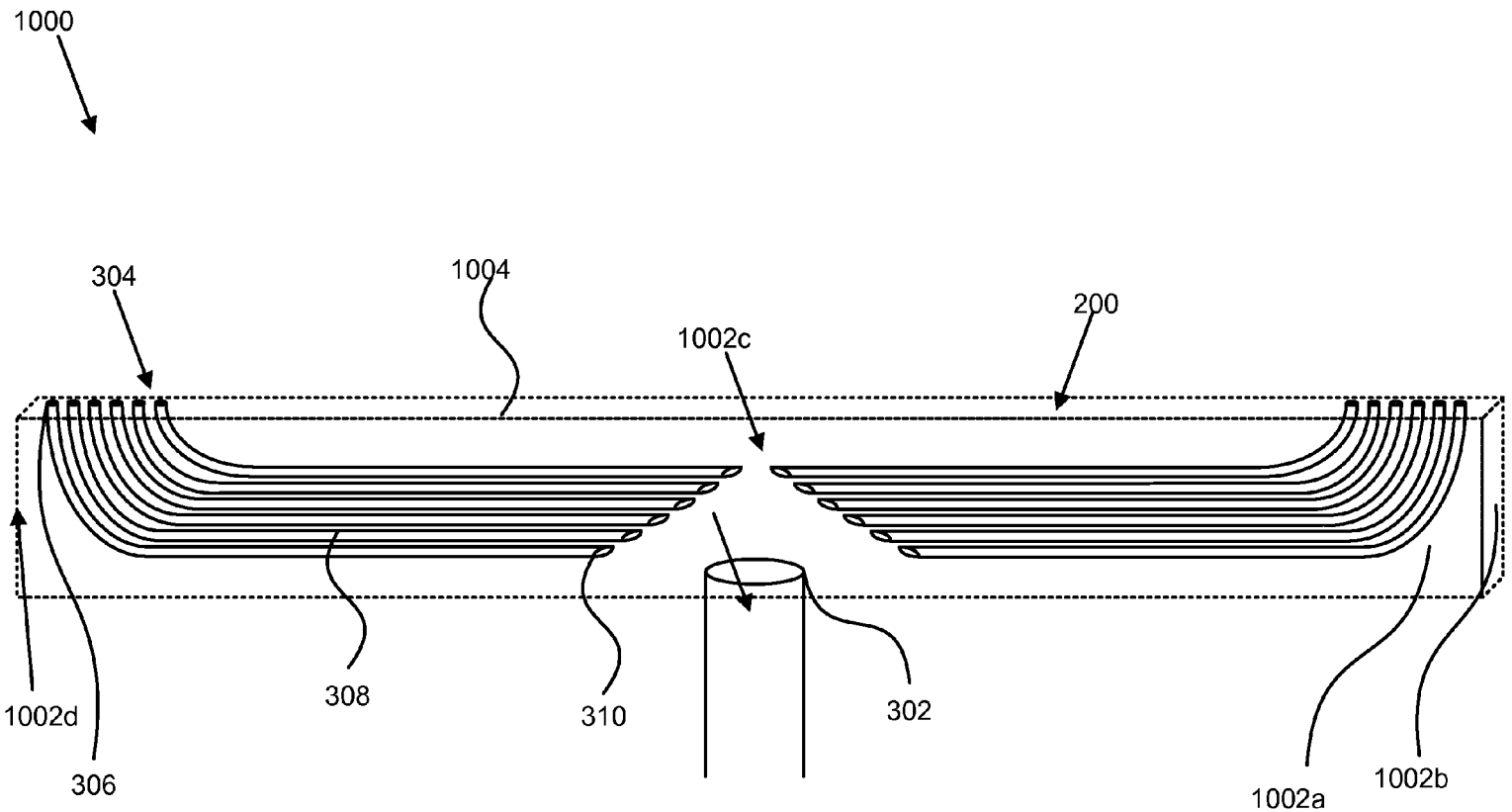
FIG. 10 is a phantom, perspective view of a rectangular cover housing tubes extending down from the top of the cover, the top of the cover being the same plane as a pool floor, and then proceeding horizontally toward a pool drain.

Referring now to FIG. 10, an apparatus 1000 houses tubes extending down from a plane defined by a pool floor and then proceeding horizontally toward a pool drain. The apparatus 1000 includes a cover 200. The cover 200 includes a flat region 1004 similar to the flat region 204*a*-204*d* depicted in FIGS. 2*a*-2*d*. However, unlike FIGS. 2*a*-2*d*, apparatus 1000 includes sidewalls 1002*a*-1002*d* in the place of a ramp 202*a*-202*d* around the perimeter of the flat region 1004.

Furthermore, unlike other embodiments, the distal openings 306 of the tubes 308 disposed within the cover 200 are connected to apertures 304 in the flat region 1004. The tubes 308 extend toward a pool drain 302. In one embodiment, the tubes 308 are curved, as depicted in FIG. 10, so that after drooping vertically, the tubes 308 extend horizontally toward the pool drain 302.

The sidewalls 1002*a*-1002*d* extend equally in a direction orthogonal to the plane of the flat region 1004, allowing the cover 200 to sit within a pocket, excavated in the pool floor. Although the sidewalls 1002*a*-1002*d* of the apparatus 1000 depicted in FIG. 10 form a rectangle, they may also form other shapes—such as a circle, in the case that the cover 200 is also circular, as depicted in FIG. 2*c*. Once situated in the pocket, the sidewalls 1002*a*-1002*d* support the cover 200 so that the plane of the flat region 1004 of the cover 200 coincides with the plane of the pool floor. The pocket may be excavated during pool construction or as part of a retrofit of an existing pool.

Under the embodiment of FIG. 13, the tubes 308 extend diagonally, at a negative angle, toward the pool drain 302. The tubes 308 extend from the flat region 1004 to a sump region 1301. The sump region 1301 connects with the pool drain 302. Other shapes for the tubes 308 are possible under the embodiments of both FIGS. 10 and 13. The flat region 1004 is substantially flush with the pool floor 1303. The apertures are also substantially flush with the pool floor. Apertures disposed on the distal ends of the tubes may be similar in shape to those present in other embodiments. As in other embodiments, a cap may be disposed on the flat region 1004. The pool drain 302 is preferably accessible through the cap.

Both FIGS. 10 and 13 may be installed with a new pool or may be installed by the user on an existing pool. When installed in an existing pool, an area of the pool floor may have to be excavated around the pool drain. The pool drain cover is then installed so that the flat region 1004 is substantially flush with the pool floor. Under another embodiment, the pool floor is constructed to rise at an angle to meet the flat region 1004 of the pool drain cover.

Figure 11:
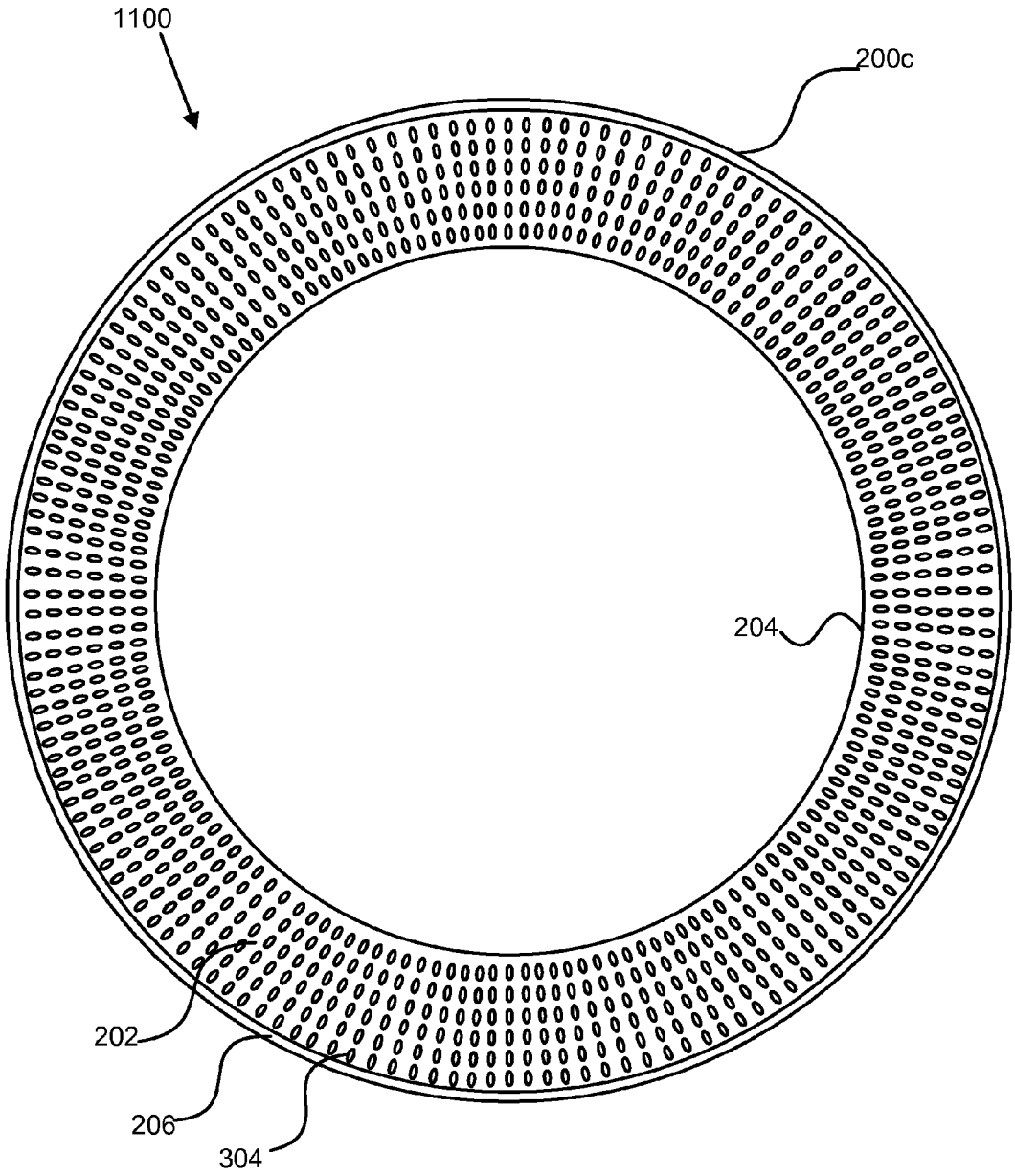
FIG. 11 is a top view of a circular cover with six rows of apertures in a ramp around the perimeter of the cover.

Referring now to FIG. 11, which depicts an apparatus 1100 housing tubes extending toward a pool drain from the perimeter of a circular cover. FIG. 11 depicts a top view of a circular cover 200*c* similar to that depicted in FIG. 2*c*. The cover 200*c* has a flat region 204*c* extending from its center out toward a ramp 202*c* that circumscribes the perimeter of the cover 200*c*. The cover also has a seal 206*c* that circumscribes the perimeter of the cover 200*c* at its base.

Disposed within the ramp are six rows of apertures 304, each row circumscribing the ramp 202*c*. Operatively connected to the apertures 304, within the cover 200*c*, are tubes 308, extending toward a pool drain 302, also covered by the cover 200*c*.

Under the embodiment of FIG. 12, the apparatus 1200 houses tubes extending toward a pool drain from the perimeter of a circular cover. Disposed within the ramp are oval apertures 1201. The cross-sectional area of the oval apertures 1201 is similar to the elliptical channel 603 of FIG. 7*a*, wherein the major axis 702*a* is much greater than the minor axis 704*a*. This design allows for a greater flow rate through the apparatus 1200 without creating an area that is large enough for a child's finger. FIG. 12 also shows a top connecting plate 216 disposed on the flap region 204. As shown in FIG. 14, the top connecting plate 216 covers the pool drain. Under certain embodiments, the top connecting plate 216 is removable. This permits access to the pool drain in the case that maintenance in needed or the pool drain becomes clogged.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A drain cover comprising:

a cover for housing a plurality of tubes, the cover having a center and a peripheral edge;

a plurality of straight, substantially horizontal disposed tubes circumscribing channels with substantially continuous cross-sectional areas within the cover, each of said tubes having a distal opening connected with the cover and terminating at the peripheral edge of the cover and a proximal opening directed substantially at the center of the cover, wherein each of the tubes have a length of at least six inches.

2. The apparatus of claim 1, wherein the cover further comprises:

the cover extending outward from the central point in all three-hundred and sixty degrees of a horizontal plane defined by a direction x and a direction y, where x and y are perpendicular to each other, to occupy a geometric footprint, wherein the distance between at least two points on the perimeter of the geometric footprint is at least two feet in length; and a ramp described by the cover ascending to a uniform height from a uniform point with relation to a direction z, where z is orthogonal to the horizontal plane defined by x and y, the ramp ascending at a substantially uniform rate from all three-hundred and sixty degrees of the perimeter of the cover.

3. The apparatus of claim 1, wherein the cover is comprised of interconnected segments.

4. The apparatus of claim 1, further comprising a sealing material near the perimeter of the cover.

5. The apparatus of claim 1, each tube comprises a channel extending the length of the tube with a substantially elliptical cross sectional area, the elliptical cross sectional area having a major axis.

6. The apparatus of claim 5, further comprising a ramp described by the cover and ascending from the perimeter of the cover to a uniform height and the major axis of the substantially elliptical cross sectional area disposed in the direction and of a length that causes the channel to occupy most of the distance from a point at the top of the ramp to a point at the bottom of the ramp.

7. The apparatus of claim 6, further comprising a series of tubes with channels whose distal openings are arranged one next to the other in a single row around the ramp.

8. The apparatus of claim 1, wherein each tube has a length in the range of between about six to about twenty-four inches.

9. The apparatus of claim 1, wherein the each tube has a length in the range of between about six to about eighteen inches.

10. The apparatus of claim 1, wherein at least one tube has a sidewall terminated at the proximal opening, the terminated sidewall tapered to a cutting edge.

11. The apparatus of claim 1, wherein the distal and proximal openings of at least one tube are offset with respect to the distal and proximal openings of at least one other tube.

12. The apparatus of claim 1, wherein the distal opening of each tube has a cross sectional width of about ¼ inch.

13. The apparatus of claim 1, wherein the tubes are arrayed in columns and rows.

14. The apparatus of claim 13, wherein the tubes are arrayed in six rows.

15. The apparatus of claim 1, wherein the distal openings of the tubes are separated.

16. The apparatus of claim 1, further comprising a ramp rising at a substantially uniform rate from all points of the perimeter of the cover.

17. The apparatus of claim 16, wherein a non-perforated region of the cover extends from the central point of the cover to the top of in all three-hundred and sixty degrees of a horizontal plane to occupy a geometric footprint, the geometric footprint circumscribed by the perimeter of the cover.

18. The apparatus of claim 17, wherein the non-perforated region is flat.

19. The apparatus of claim 17, wherein the non-perforated region is domed.

20. The apparatus of claim 16, wherein the ramp ascends at a grade less than thirty (30) degrees.

21. The apparatus of claim 16, wherein the ramp ascends to a height less than three inches.

22. The apparatus of claim 1, wherein the cover is secured to the pool drain with at least one plastic, push-in fastener.

23. The apparatus of claim 1, wherein the cover is secured to the pool drain with drop-in anchors, the drop-in anchors being secured to a pool floor through openings in the pool floor.

24. The apparatus of claim 1, wherein the cover is secured to the pool drain with at least one j-bolt.

25. The apparatus of claim 1, wherein the cover is secured to the pool drain with at least one lag bolt.

26. The apparatus of claim 1, further comprising a cap disposed in the cover, the cap being removable to allow access to the pool drain.

27. The apparatus of claim 1, wherein the cover for housing a plurality of tubes is substantially flush with a pool floor of the pool.

28. The apparatus of claim 27, wherein the tubes are disposed at an negative angle to the pool floor, the tubes circumscribing channels with substantially continuous cross-sectional areas, each tube having a distal opening connected with the cover and a proximal opening directed substantially at the pool drain, wherein each of the tubes have a length of at least six inches.

29. A drain cover comprising:

a segmented cover for covering a drain, the segmented cover having a center and a peripheral edge and extending outward from the central point in all three-hundred and sixty degrees of a horizontal plane defined by a direction x and a direction y, where x and y are perpendicular to each other, to occupy a geometric footprint, wherein the distance between at least two points on the perimeter of the geometric footprint is at least two feet in length;

a perforated ramp described by the cover and ascending to a uniform height from a uniform point with relation to a direction z, where z is orthogonal to the horizontal plane defined by x and y, the ramp ascending at a substantially uniform rate of less than thirty (30) degrees from all three-hundred and sixty degrees of the perimeter of the cover to a height less than three inches;

a flat, non-perforated region of the cover centered at the center of the cover and on top of the ramp;

a plurality of straight, horizontally disposed tubes, circumscribing channels with substantially continuous cross-sectional areas, each channel extending the length of the tube, each tube having a distal opening connected with the cover and terminating at a perforated point along the ramp and a proximal opening directed substantially at the center of the cover, each of the tubes have a length of at least six inches, each tube with a substantially elliptical cross sectional area, the major axis of the substantially elliptical cross sectional area disposed in the direction z and of a length causing the channel to occupy most of the distance in direction z from a point on top of the ramp to its bottom; and a conical cavity with a truncated top under the non-perforated region of the cover and above the pool drain, the proximal opening of each channel emptying into the conical cavity.

* * * * *